United States Patent [19]

Yoshizawa et al.

[11] Patent Number: 4,526,611

[45] Date of Patent: Jul. 2, 1985

[54] PROCESS FOR PRODUCING SUPERFINES OF METAL

[75] Inventors: Akinori Yoshizawa, 5-24-16, Nakano, Nakano-ku, Tokyo; Yasuo Nakane, Tokyo; Kenji Hagimori, Takasaki; Koya Ohgai, Funabashi; Norisada Arisawa; Tadashi Takahashi, both of Fujioka; Hideaki Maekawara, Annaka; Hiroyuki Imaizumi, Fujioka; Hideyuki Tsuchida, Tokyo; Eiichirou Mieno; Kenji Sugino, both of Annaka, all of Japan

[73] Assignees: Toho Zinc Co., Ltd.; Akinori Yoshizawa, both of Tokyo, Japan

[21] Appl. No.: 586,006

[22] Filed: Mar. 5, 1984

[30] Foreign Application Priority Data

Mar. 14, 1983 [JP] Japan ..... 58-41970

[51] Int. Cl.[3] ..... B22F 9/00

[52] U.S. Cl. ..... 75/0.5 B; 75/0.5 BA

[58] Field of Search ..... 75/0.5 AA, 0.5 BA, 0.5 B; 148/105, 108

[56] References Cited

U.S. PATENT DOCUMENTS 2,664,352 12/1953 Darner et al. ..... 75/0.5 AA
3,955,962 5/1976 Dawihl et al. ..... 75/0.5 AA
4,383,852 5/1983 Yohizawa ..... 75/0.5 B

FOREIGN PATENT DOCUMENTS 59-7765 3/1982 Japan .

OTHER PUBLICATIONS

"Flame Structure", Chapter II, R. M. Fristrom and A. A. Westenberg, The Applied Physics Laboratory, The John Hopkins University, McGraw-Hill Book Company, 1965.

"Boundary Layer Theory", 7th Edition, Chapter XXIV, Hermann Schlichting (Translated by J. Kestin), McGraw-Hill, Inc., 1979.

"Formation of Fine Silicon Carbide Powders by a Vapor Phase Method", Y. Okabe, J. Hojo and A. Kato, Department of Applied Chemistry, Faculty of Engineering, Kyushu University, Journal of the Less-Common Metals, vol. 68, pp. 29-41, 1979.

"$TiO_2$ Produced by Vapor-Phase Oxygenolysis of $TiCl_4$", Y. Suyama and A. Kato, Department of Applied Chemistry, Faculty of Engineering, Kyusyu University, Journal of the American Ceramic Society, vol. 59, No. 3-4, pp. 146-149, 1976.

*Primary Examiner*—W. Stallard

*Attorney, Agent, or Firm*—Frishauf, Holtz, Goodman & Woodward

[57] ABSTRACT

An improved process for producing superfines of metal is disclosed, which comprises reacting a metal halide containing gas with a reducing gas by causing to flow both the stream of a metal halide containing gas and the stream of a reducing gas concurrently but at different velocities so as to form an interfacial instability region in the reaction zone, and nuclei are formed in said instability region whereas said reaction zone is quenched (cooled) to inhibit the excessive growth of said nuclei. Application of a magnetic field to the reaction zone can enhance the degree of fineness and magnetic properties of the superfines thus produced.

14 Claims, 6 Drawing Figures

PROCESS FOR PRODUCING SUPERFINES OF METAL

BACKGROUND OF THE INVENTION

The present invention relates to a process for producing superfines of metal. More particularly, the invention relates to a process for producing ferromagnetic particles with a single magnetic domain by a vapor-phase reaction.

With the recent increase in the demand for high-density magnetic recording mediums, magnetic particles are required to have improved characteristics, namely, high coercivity and great saturation magnetization. The second factor is material dependent, but the first factor has a maximum value when the individual particles of the material have a single magnetic domain and are in either an acicular or straight-chain form. Therefore, the ideal magnetic material can be provided from superfines of metal having a single magnetic domain.

The structure of the magnetic domain depends on the particle size of a magnetic material. For large particles, a structure with more than one magnetic domain is predominant, but as their size is decreased, a structure with a single magnetic domain becomes predominant, and with an even smaller particle size, super-paramagnetism comes into action. While the particle size that provides a single magnetic domain varies with the type of metal or alloy, iron and cobalt particles have a single magnetic domain at a size in the range of 10 to 30 nm.

Superfines of a magnetic metal are known to be made of metallic iron particles or alloy particles wherein iron is alloyed with vanadium, chromium, manganese, cobalt, nickel, copper or zinc. These superfines of metal are typically produced by either oxide reduction or vapor condensation. In the first method, acicular iron oxide or oxyhydroxide particles prepared by a suitable technique such as wet precipitation are reduced into superfines of pure iron by heating in hydrogen atmosphere at low temperatures ranging from 300° to 400° C. The resulting particles are in most cases acicular and their size is 50 nm by 300–700 nm. However, these particles tend to have internal voids, and magnetization that occurs in these voids provides a structure having more than one magnetic pole which is detrimental to the uniform dispersion of magnetic particles in a magnetic paint and which hence impairs the orientation in magnetic tape or reduces its coercivity. As a further disadvantage, in order to prevent sintering during reduction, the fine oxide particles must be heated at low temperatures for an extended period, and this requires large equipment and leads to great consumption of hydrogen.

The second method or vapor condensation involves forming the vapor of iron or iron-cobalt alloy in an argon gas in a low degree of vacuum. This method provides superfines of metal of a size of 5–50 nm in the form of long chains. However, this method requires the use of an expensive heating furnace and evacuating chamber, and the working under vacuum is uneconomical because of low efficiency and productivity. Other problems with the use of vacuum are low cooling rate and the increased chance of sintering of deposited particles. The junction of single particles is easily sintered so as to provide a structure having more than one magnetic domain. Fine particles with this structure are either in the form of curved chains or a net of intertwined agglomerates.

One of the inventors of the present invention has filed Japanese Patent Application No. 127415/80 (and corresponding U.S. Pat. No. 4,383,852) wherein he proposed a process for producing fine metal particles by a vapor-phase reaction consisting of reacting a reducing gas with the vapor of a metal halide having a lower boiling point than a metal. This method provided fine particles of iron-copper, iron-nickel or iron-nickel-cobalt alloy having a size of 40–600 nm. However, much finer particles of a size of 10–30 nm having a structure with a single magnetic domain were difficult to obtain by this method.

SUMMARY OF THE INVENTION

The present invention has been accomplished in order to solve this problem. The invention provides a process for producing superfines of metal by reacting a metal halide containing gas with a reducing gas, wherein the stream of said metal halide containing gas and the stream of said reducing gas are caused to flow concurrently but at different velocities so as to form an interfacial instability region in the reaction zone, and nuclei are formed in said instability region whereas said reaction zone is quenched to inhibit the excessive growth of said nuclei. In a specific embodiment of the invention, the zone of reaction between the metal halide containing gas and the reducing gas is confined in a magnetic field so that the formation of nuclei and the inhibition of their excessive growth are effected within said magnetic field.

The superfines of a magnetic metal according to the present invention are generally made of iron, iron-cobalt or iron-cobalt-nickel. The metal halides used as the starting material are generally selected from among metal chlorides (e.g. $FeCl_2$, $CoCl_2$ and $NiCl_2$) because of their easy availability. The reaction between the vapor of these chlorides and a reducing hydrogen gas is an exothermic reaction that takes place in the temperature range of 1100° to 1500° K. In the presence of excessive hydrogen, the reaction proceeds very rapidly by forming a kind of combustion flame. When the chloride vapor containing gas and the hydrogen gas that surrounds it (or instead, the hydrogen gas may be surrounded by the chloride vapor containing gas) are caused to flow concurrently but at different velocities (in other words, a difference in velocity is established between the two gas streams at their interface in the vapor-phase reaction zone), a series of small vortexes are successively formed along the interface between the two gases, and these vortexes provide ensemble a non-uniform interface or an interfacial instability region, in which a number of nuclei are formed and increase in size.

As a result of various studies on the conditions for producing superfines, the present inventors came to note the effect of temperature on the formation and growth of nuclei, in particular the favorable effect of decreased temperature on the inhibition of the excessive growth of nuclei. The inventors continued their research along this line and finally found that by lowering the ambient temperature of the combustion flame, or more specifically, by cooling the reaction zone in order to minimize the exposure of nuclei to elevated temperatures, the nuclei are quenched and their excessive growth is inhibited, with the result that superfines not larger than 100 nm can be easily obtained. The reaction zone can be cooled not only with water but also by introducing a cold gas such as a reducing gas or an inert gas.

The present inventors have also found that by performing all reactions including the quenching of nuclei in a magnetic field, even smaller particles consisting of a single magnetic domain can be easily obtained. A plausible explanation for this phenomenon is that in a magnetic field, the growth of excessively small particles is accelerated but if they grow to a size providing a single magnetic domain, their further growth is inhibited. Such particles, because of their structure with a single magnetic domain, are magnetically linked to form straight chains each consisting of about 10 particles. These straight chains are particularly suited to the purpose of the present invention.

DETAILED DESCRIPTION OF THE INVENTION

Figure 1:
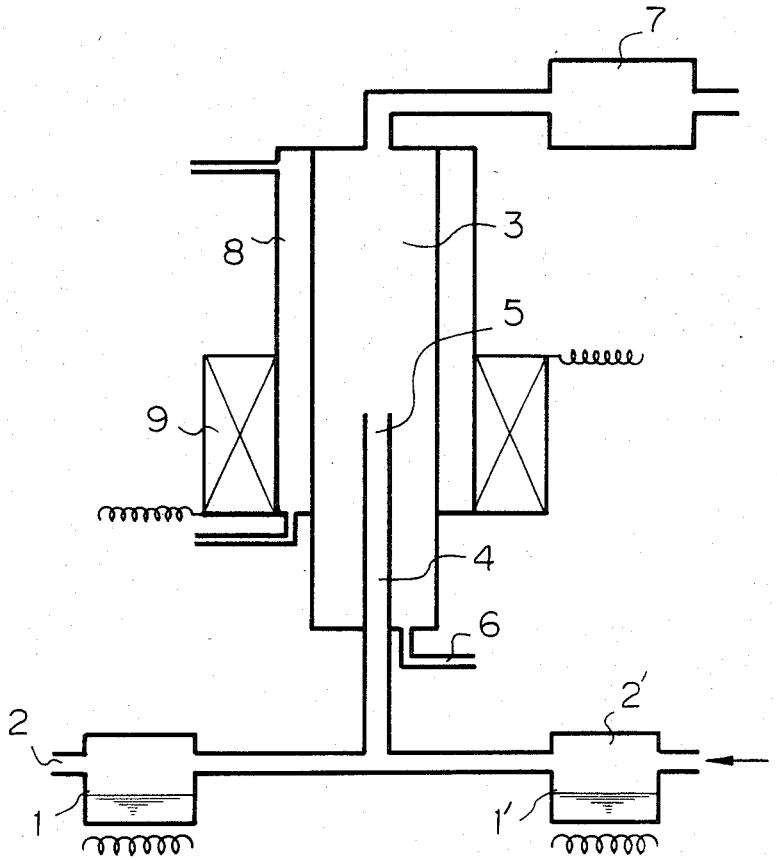
FIG. 1 shows schematically an apparatus to be used in implementing the process of the present invention.
Figure 2A:
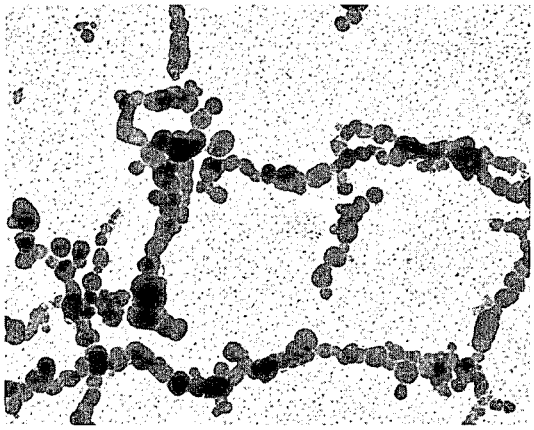
FIG. 2 shows TEM micrographs (×50,000) of the superfines (a) to (e) produced in the Example.
Figure 2B:
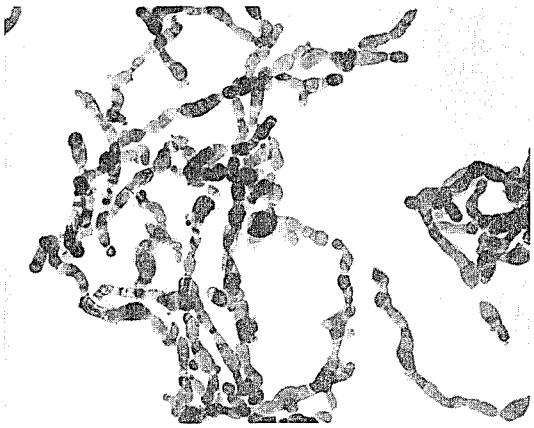
Figure 2C:
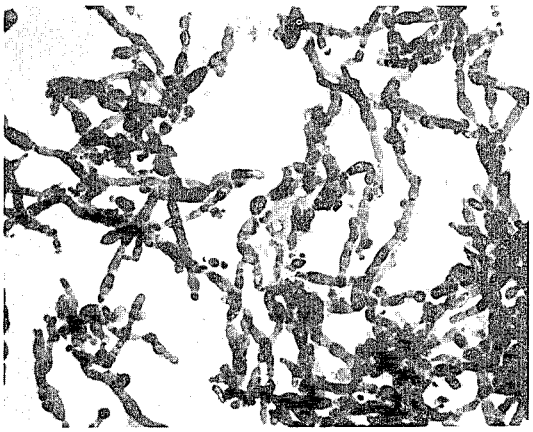
Figure 2D:
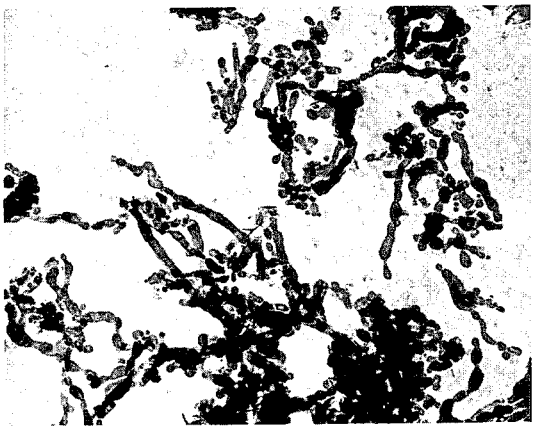
Figure 2E:
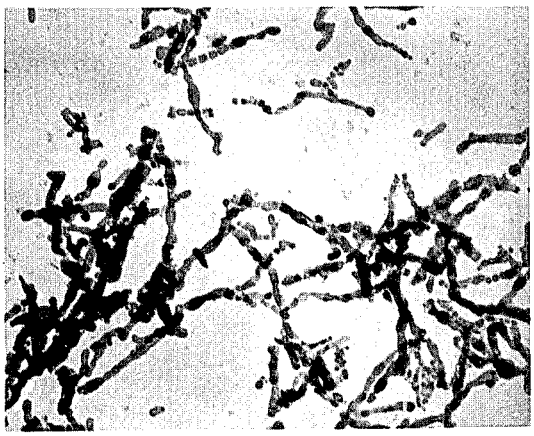

The present invention is hereunder described in detail by reference to FIG. 1 which shows schematically one apparatus for implementing the process of the present invention. First, the metal halide is charged into boilers 1 and 1'. The number of the boilers depends on the desired production output and the specific production method. In order to produce alloy particles, one or more boilers may be provided for the chloride of each metal component of the alloy and depending upon the proportions of the respective chlorides. By this arrangement, fine alloy particles can be easily produced and this is one great advantage of the present invention. The interior of each boiler is heated to a temperature that depends on the specific concentration of the halide vapor. A predetermined amount of a diluent gas (an inert gas such as argon or nitrogen) is introduced through pipes 2 and 2' so as to obtain a gas containing the metal halide vapor of a predetermined concentration and flow rate. This gas is blown upward into a reaction column 3 through the nozzle 5 of a pipe 4 extending halfway into the reaction column. A reducing gas (e.g. hydrogen or ammonia decomposition gas) is introduced into the column 3 from below through a pipe 6. The introduced reducing gas forms an ascending flow that surrounds the stream of halide containing gas, and the two gases that are in contact with each other are reacted to form a combustion flame at their interface. In this case, if the two gases flow at different velocities, for example, if the reducing gas flows faster than the halide containg gas, their reacting interface forms an instability region. In this instability region, the two gas phases form mutually contacting thin laminar flows, and microscopically, the two gases are in admixture forming vortexes wherein one gas sinks in the other. Because of its high reactivity in vapor phase, the interfacial instability region provides favorable conditions for the formation of many nuclei and the subsequent formation of fine particles. The nuclei formed in the reaction column are carried by the ascending gas stream and enter a collection zone 7 where they are collected in the form of superfines. In a modified embodiment, the reducing gas, such as hydrogen, may be caused to flow in the center of the column 3 whereas the halide containg gas is caused to flow to provide an envelope for the hydrogen gas. Alternatively, the two gases may be permited to flow horizontally rather than vertically.

According to the present invention, the reaction column 3 is enclosed by a jacket 8 through which water is circulated to cool the combustion flame being formed in the column. In an experiment we conducted, the ambient temperature of the flame could be reduced to 600° C. by using this jacket and the temperature above the flame could be reduced to less than 400° C. Because of these conditions, the excessive growth of the nuclei formed in the reaction column could be significantly inhibited. The conventional vapor-phase process for producing superfines of metal uses a furnace having no cooling means as the reaction column. According to the present invention, the non-cooled furnace is replaced by a water-cooled reactor, and by this modification, particles much smaller than the conventionally obtained size can be produced.

In a preferred embodiment of the present invention, a solenoid coil 9 is formed by winding a copper wire around the water-cooling jacket 8, particularly the reaction zone of the column 3 where the halide containing gas is injected to form a combustion flame. When a predetermined amount of electric current is passed through the coil, a magnetic field is formed, and by performing the combustion reaction within the magnetic field, the excessive growth of the nuclei formed in the reaction column can be more effectively inhibited. As will be apparent from the working example shown later in this specification, the size of the particles formed can be decreased by increasing the strength of the magnetic field. At a magnetic field strength of 600 Oe or more, preferably above 900 Oe, particles of a size of about 20 nm can be formed. They are uniform in size and each of them consists of a single magnetic domain, so they are in the form of straight chains and are substantially free of curved chains and a net of intertwined agglomerates.

In the preferred embodiment shown above, the magnetic field may be formed by a technique other than using a solenoid coil.

The superfines of metal or alloy according to the present invention are highly suitable for use as magnetic recording mediums. However, the use of such superfines is not limited to magnetic recording, and hence, the particles of the present invention may be used in many other applications.

The advantages of the present invention are hereunder described by an illustrative example using the apparatus shown in FIG. 1. It should be noted that the manner in which the metal halide containing gas and the reducing gas are introduced is not limited to this particular example. If necessary, the reducing gas may impinge on the halide gas at such an angle that the contact between the laminar flows of the two gases is not prevented.

Example

Ferrous chloride ($FeCl_2$) and cobalt chloride ($CoCl_2$) were used as metal halides, and hydrogen was used as a reducing gas. A gas containing 2% by volume of vapors of the two metal chlorides was introduced at a rate of 1 mol/min of total chlorides into the reactor having a reaction column with an inside diameter of 40 mm and an effective length of 800 mm. The hydrogen gas was fed into the reactor at a rate of 2 mol/min. The reaction between the metal halide containing gas and the hydrogen gas was effected under five different conditions: (a) the reactor was used as a non-cooled furnace, (b) the reactor was equipped with a water-cooling jacket, (c) the jacketed reactor was further equipped with a solenoid coil that produced a magnetic field of 300 Oe, (d) the same as in (c) but the solenoid coil produced a magnetic field of 600 Oe, and (e) the same as in (c) but a magnetic field of 900 Oe was produced. In each experiment, the temperature of the reaction zone was about 1,000° C. TEM micrographs (×50,000) of the five samples of superfines are shown in FIGS. 2(*a*) (*b*), (*c*), (*d*) and (*e*), respectively. The specific surface area, coercivity and saturation magnetization of each sample are shown in Table 1. The alloy composition of each sample was 70% Fe and 30% Co. As is clear from FIG. 2, the particle size decreases in the order of (*a*) to (*e*), and the particles which form curved chains as shown in FIG. 2(*a*) have changed, passing through the forms as shown in FIGS. 2(*b*), 2(*c*), and 2(*d*), to straight chains as shown in FIG. 2(*e*) each of which consists of a single magnetic domain. Thus, the advantages of water-cooling the reactor, applying a magnetic field and increasing the magnetic field strength are obvious.

TABLE 1

| | (a) | (b) | (c) | (d) | (e) |
|---|---|---|---|---|---|
| Specific surface area ($m^2/g$) | 12.6 | 18.3 | 24.8 | 27.6 | 29.6 |
| Coercivity (Oe) | 940 | 1310 | 1540 | 1560 | 1600 |
| Saturation magnetization (emu/g) | 150 | 147 | 144 | 145 | 148 |

The specific surface area of particles is in inverse proportion to their size and is used as an index therefore. The specific surface area data in Table 1 clearly shows the advantages of the present invention. The particles prepared by the process of the present invention (b, c, d and e) have consistently high coercivities (>1000 Oe) and at the same time, they have consistently high saturation magnetization values (140–150 emu/g). This shows that the superfines according to the present invention have a structure with a single magnetic domain or a structure nearly approaching this ideal structure.

As shown in the foregoing, the cooling of the vapor-phase reaction zone and application of a magnetic field have significantly favorable effects on the inhibition of the excessive growth of particles occurring in the reaction zone.

What is claimed is:

1. A process for producing superfine metal particles in a reaction zone comprising contacting a stream of a metal halide containing gas with a stream of a reducing gas, the stream of said metal halide containing gas and the stream of said reducing gas flow concurrently and at different velocities when they contact each other to form an interfacial instability region in the reaction zone wherein nuclei of said metal are formed, said reaction being cooled to inhibit excessive growth of said metal nuclei thereby producing said superfine metal particles.

2. The process as defined in claim 1 wherein said metal halide is a metal chloride.

3. The process as defined in claim 2 wherein said metal chloride is one or two or more selected from the group consisting of iron chloride, cobalt chloride and nickel chloride.

4. The process as defined in claim 1 wherein said superfines of metal is superfines of iron, an iron-cobalt alloy or an iron-cobalt-nickel alloy.

5. The process as defined in claim 1 wherein said reducing gas is hydrogen.

6. The process as defined in claim 1 wherein the metal halide containing gas is caused to flow through the center zone of the reaction column and the reducing gas flows concurrently, surrounding the metal halide containing gas.

7. The process as defined in claim 1 wherein the reducing gas is caused to flow through the center zone of the reaction column and the metal halide containing gas flows concurrently, surrounding the reducing gas.

8. The process as defined in claim 6 or claim 7 wherein both the metal halide containing gas and the reducing gas form an ascending gas stream.

9. The process as defined in claim 6 or claim 7 wherein both the metal halide containing gas and the reducing gas flow horizontally.

10. The process as defined in any of claims 1 through 7 wherein the zone of reaction between the metal halide containing gas and the reducing gas is confined in a magnetic field so that the formation of nuclei and the inhibition of their excessive growth are effected within said magnetic field.

11. The process as defined in claim 8 wherein the zone of reaction between the metal halide containing gas and the reducing gas is confined in a magnetic field so that the formation of nuclei and the inhibition of their excessive growth are effected within said magnetic field.

12. The process as defined in claim 9 wherein the zone of reaction between the metal halide containing gas and the reducing gas is confined in a magnetic field so that the formation of nuclei and the inhibition of their excessive growth are effected within said magnetic field.

13. The process as defined in claim 1 wherein the temperature in the reaction zone above the flame is cooled to under 400° C.

14. The process as defined in claim 13 wherein the ambient temperature of the flame in the reaction zone is about 600° C.

* * * * *